US007297073B2

(12) United States Patent
Jung

(10) Patent No.: US 7,297,073 B2
(45) Date of Patent: Nov. 20, 2007

(54) WEIGHT INTERCHANGEABLE PUTTER

(76) Inventor: Man Young Jung, 2750 Washington Blvd., Suite 150, Pasadena, CA (US) 91107

( * ) Notice: Subject to any disclaimer, the term of this patent is extended or adjusted under 35 U.S.C. 154(b) by 154 days.

(21) Appl. No.: 11/177,210

(22) Filed: Jul. 9, 2005

(65) Prior Publication Data

US 2007/0010348 A1 Jan. 11, 2007

(51) Int. Cl.
*A63B 53/00* (2006.01)

(52) U.S. Cl. ..... 473/340; 473/313; 473/334; 473/251; 473/255; 473/305

(58) Field of Classification Search ..... 473/249, 473/251, 256, 334, 337–341, 313, 255, 305
See application file for complete search history.

(56) References Cited

U.S. PATENT DOCUMENTS 3,880,430 A * 4/1975 McCabe ..... 473/253
5,046,740 A * 9/1991 D'Eath ..... 473/255
5,072,941 A * 12/1991 Klein ..... 473/255
5,253,869 A * 10/1993 Dingle et al. ..... 473/245
5,429,356 A * 7/1995 Dingle et al. ..... 473/251
6,012,989 A * 1/2000 Saksun, Sr. ..... 473/341
7,070,515 B1 * 7/2006 Liu ..... 473/340

* cited by examiner

*Primary Examiner*—William M. Pierce
(74) *Attorney, Agent, or Firm*—Clement Chang, Esq.

(57) ABSTRACT

A weight interchangeable golf putter is provided having a T shaped head. The head has a main body constituting the main weight and a striking face. From the trailing edge of the top surface a center tail extends rearward to form the T shape of putter plane. At the sides of the tail there are formed end fins with their free ends opened rearward to better guide the putter head through the air during the stroking address. The top of the back weight extends to near midway of the length of the tail and merges with the bottom of the tail. The back weight has a bottom surface in flush with the corresponding bottom of the main body and terminates with an end wall tapered gradually toward the main body to avoid hitting the ground when strokes are made. Three cylindrical bores are formed facing the same backward direction in the common 90-degree angle from the rear wall to receive different metal screws. When the screws are in their initial positions the putter with its face balanced neutralizes the leftward pulling or rightward pushing in the putting of the right-handed golfer who tends to show more pulling problems. Balance adjusting at the day's practice rounds or putting will be rightfully done with ease and no special tool thanks to the protruding screw design which provides an extra visual aid as well as a structural indicator of the invisible sweet spot to improve the actual approach of the ball into the hole cup.

14 Claims, 3 Drawing Sheets

WEIGHT INTERCHANGEABLE PUTTER

BACKGROUND OF THE INVENTION

A. Field of the Invention

The present invention relates to golf putters, and more particularly to a weight interchangeable putter structure.

B. Description of the Prior Art

Golf requires delicate control of a small 45-gram golf ball over a long distances with only a number of golf clubs. Golf becomes a precision game won by the player with the least total strokes. The golf club generally consists of a grip, a shaft and a head and is categorized into woods, irons and putters. Woods or irons are the suitable clubs for long distance shots while the putter is for green putting over most preferably one or two relatively short green distances.

Typically, the putter head is designed to have an almost perpendicular clubface to the playing ground with a loft angle necessary to roll the ball. The shaft of the putter is distinctive from the other clubs in that it extends more upright from the head or has a higher lie angle allowing the player to better see the line of putting otherwise visible only by bending forward. The correct use of the putter is a two handed grip with no motion along the wrists and the arms, which in unity should make a pendulum motion sideways resulting in the ball rolling over a distance determined by the gripping force of the hands and the extent of backstroke. Specifically for short putting, wrist or fingers should not be involved in the controlling forces.

With the well known basics of putting in mind, golfers practice for lengthy periods of time to attain their own personal way of putting. Because putting is done by imperfect humans with varying psychological and physical states of the day, golfing performance can also fluctuate. In addition, individual peculiarity or habit of ball striking inevitably develops to lead the ball to all but the desired direction and speed. Golfers unknowingly adopt putting with overly short or long grips, bent posture or a straight waist becomes natural habits. To inhibit such habits, many golfers just repeat to practice countless times following same putting tips out of standard manual, which in reality can not be applied literally to various individuals of different characteristics. It would be rational to develop one's physical condition or the habit to his or her advantage to get the desirable score.

A more realistic solution is customizing a putter to compensate the golfer's varying conditions where controlling the putting directions imparted to the ball with a consistent precision is priority. However, the putters currently available are ready made to standard builds of people failing to adapt to the individual golfers. Thus, some club heads with adjustable weights have been suggested by U.S. Pat. Nos. 1,901,562; 5,058,895; 6,348,014 B1; and 6,896,625.

SUMMARY OF THE INVENTION

The T shaped head of the putter has a main body constituting the main weight and a striking face. Top surface extends parallel to the ground and has an opening near its one end to accommodate a shaft with a double bend leading to a grip for the golfer. From the trailing edge of the top surface a center tail extends rearward to complete the T shape of putter plane. At the sides of the tail there are formed end fins with their free ends opened rearward to better guide the putter head through the air during the stroking address.

The center tail may be painted white to give a well contrasted line in the green grass of the course.

Opposite of the face is a rear wall from which a back weight branches centrally perpendicular to the main body. The top of the back weight extends to near midway of the length of the tail and merges with the bottom of the tail. The back weight has a bottom surface in flush with the corresponding bottom of the main body and terminates with an end wall tapered gradually toward the rear wall to avoid hitting the ground when the golfer makes strokes. A cylindrical bore is formed on one end of the rear wall, as is a similar bore formed on the other end. A center bore is also formed on the tapered end wall of the back weight. The three bores face the same backward direction in the common 90-degree angle from the rear wall. The bores are threaded internally to secure the weighting scheme of the present invention, which is incorporating three different metal screws A, B and C with an identical shape. Each screw has threads at one end and crossed grooves at its opposite end to engage any edges like a coin to turn it in a tightening or unscrewing direction.

If, for example, the total weight of the putter head is set as 340 grams, it includes the weights of the screws A, B and C. The screw A is the heaviest of the group of three and may be made of tungsten. Screw B may be white or silicon bronze and the screw C is the lightest of the three and may be made of aluminum.

When the screws are fastened to their initial bores, i.e. the screw A is in one side bore, the screw B in the other side bore and the center screw C in the center bore, their weights balance the putter face. In other words, such positioning of the weight screws make the face balanced putter wherein the virtual extension line of the shaft toward the head comes into contact with the center of gravity of the putter head in a natural state when no dynamics are involved. To achieve the precise balancing in the putter manufacture the length of the screws A, B and C should be first calculated with the determination of the actual center of gravity of the putter product including the shaft and then the screws are attached in their initial bores to fine-tune their respective masses by boring in their walls at the threaded ends which enter the bores of the main body.

Therefore, when the screws are in their initial positions the putter with its face balanced neutralizes the leftward pulling or rightward pushing in the putting of the right-handed golfer who tends to show more pulling problems. At the same time, the double bend shaft mitigates the twisting of the putter head upon hitting the ball with its off center areas resulting in a widened sweet spot to give the right direction to the ball in more occasions.

With such construction of the putter, manipulating the weight distribution in the putter head has become easy by the present invention Accordingly, the general object of the present invention is to provide a golf putter with speedy adjustment of the weight distribution in the head.

Another object is to provide a golf putter having an alignment aid and weight-adjusting members which provide an extra visual aid as well as a structural indicator of the invisible sweet spot to improve the actual approach of the ball into the hole cup.

Figure 1:
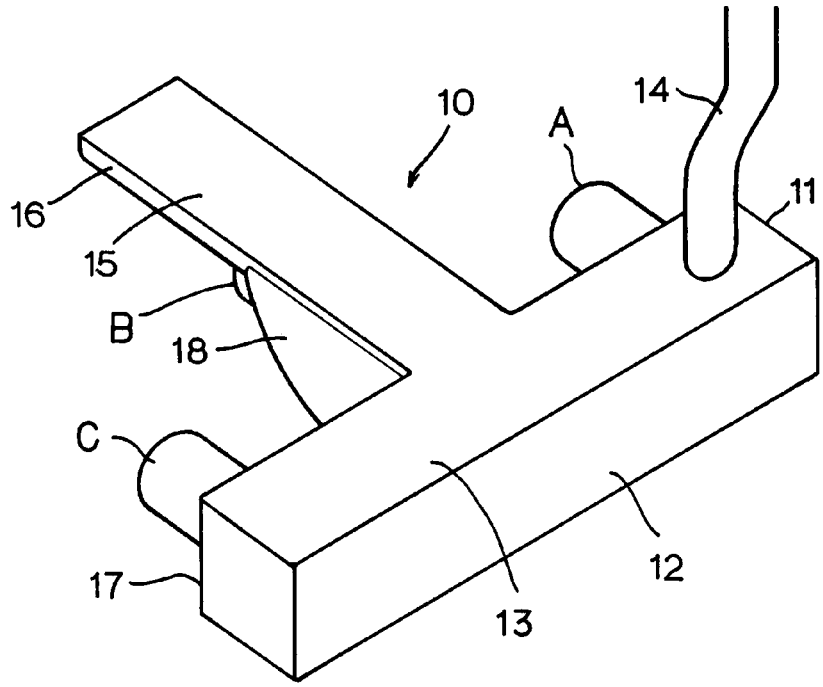
FIG. 1 is a perspective view of the putter of the present invention.
Figure 2:
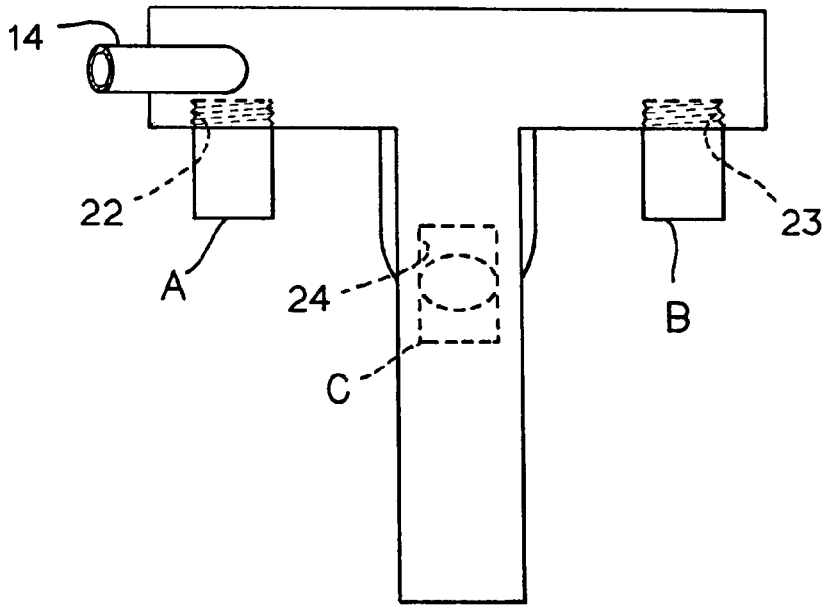
FIG. 2 is a plan view of the putter of FIG. 1.

Embodiments of the invention will now be described by way of example with reference to the accompanying drawings.

DETAILED DESCRIPTION OF THE PREFERRED EMBODIMENT

Referring to the drawings, the putter head of the present invention is generally denoted by 10 in the shape of a T. The head 10 has a main body 11 constituting the main weight and a striking face 12. Top surface 13 extends parallel to the ground and has an opening near its one end to accommodate a shaft 14 with a double bend leading to a grip for the golfer which is not shown. From the trailing edge of the top surface 13 a center tail 15 extends rearward to form the T shape of putter plane. At the sides of the tail 15 there are formed end fins 16 with their free ends opened rearward to better guide the putter head through the air during the stroking address. The center tail may be painted white to give a well-contrasted line in the green grass of the course.

Figure 3:
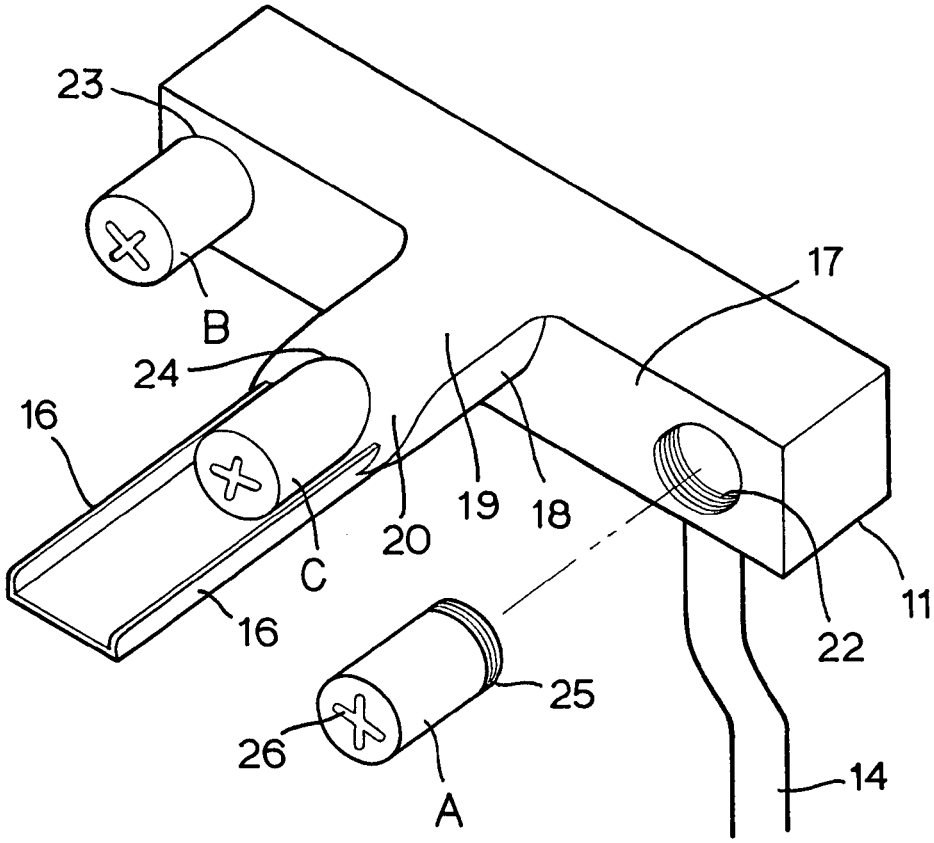
FIG. 3 is a perspective bottom view of the putter of FIG. 1.
Figure 4:
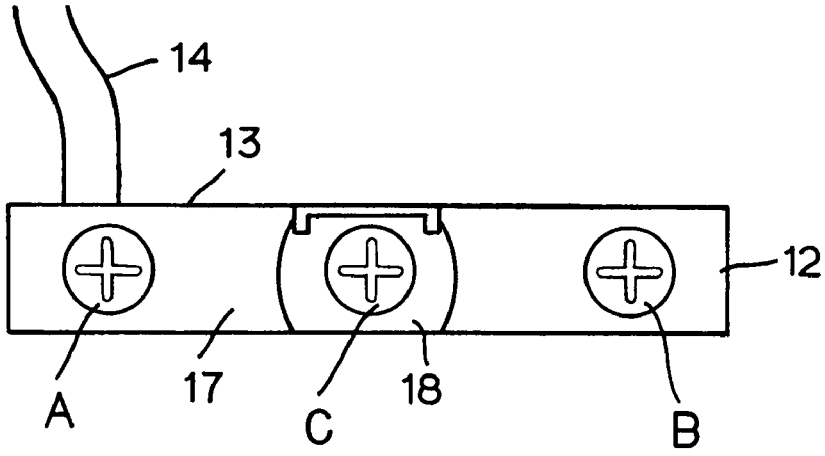
FIG. 4 is a rear view of the putter of FIG. 1.
Figure 5:
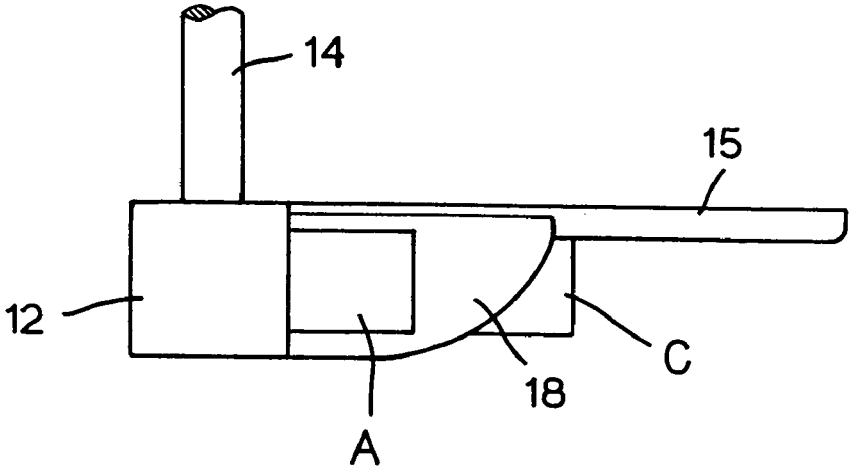
FIG. 5 is a side view of the putter of FIG. 1.

Opposite of the face 12 is a rear wall 17 from which a back weight 18 branches centrally perpendicular to the main body 11. The top of the back weight 18 extends to near midway of the length of the tail 15 and merges with the bottom of the tail 15. As shown in FIG. 3, the back weight 18 has a bottom surface 19 in flush with the corresponding bottom of the main body 11 and terminates with an end wall 20 tapered gradually toward the rear wall 17 to avoid hitting the ground when the golfer makes strokes. A cylindrical bore 22 is formed on one end of the rear wall 17, as is similar bore 23 formed on the other end. Bore 24 is also formed on the tapered end wall 20 of the back weight 18. The bores 22-24 face the same backward direction in the common 90-degree angle from the rear wall 17. The bores 22-24 are threaded internally to secure the weighting scheme of the present invention, which is incorporating three different metal screws A, B and C with an identical shape. Each screw has threads 25 at one end and crossed grooves 26 at its opposite end.

If for example the total weight of the putter head 11 is set as 340 grams, it includes the weights of the screws A, B and C. The screw A is the heaviest of the group of three and may be made of tungsten. Screw B may be white or silicon bronze and the screw C is the lightest of the three and may be made of aluminum.

When the screws are fastened to their initial bores, i.e. the screw A is in the bore 22, the screw B in the bore 23 and the center screw C in the bore 24, their weights balance the putter face 12. In other words, such positioning of the weight screws make the face balanced putter wherein the virtual extension line of the shaft 14 toward the head comes into contact with the center of gravity of the putter head 10 in a natural state when no dynamics are involved. To achieve the precise balancing in the putter manufacture the length of the screws A, B and C should be first calculated with the determination of the actual center of gravity of the putter product including the shaft 14 and then the screws are attached in their initial bores to fine-tune their respective masses by boring in their walls at the threaded ends which enter the bores 22-24 of the main body 11.

Therefore, when the screws are in their initial positions the putter 11 with its face balanced neutralizes the leftward pulling or rightward pushing in the putting by the right-handed golfer who tends to show more pulling problems. At the same time, the double bend shaft 14 mitigates the twisting of the putter head upon hitting the ball with its off center areas resulting in a widened sweet spot to give the right direction to the ball in more occasions.

With such construction of the putter 10, manipulating the weight distribution in the putter head has become easy by the present invention:

As is discussed above, directing the ball in all the wrong courses is due to the human error factors leading to the missed sweet spot and the individual effective lie angle of the shaft created by the golfer's physique and posture among others. To compensate the variable parameters around the putter 10, the golfer can exchange the positions of the weight screws A, B and C using any flathead edge like a coin.

Although changing the configuration of a golf club during a game is prohibited by standard golf rules, balance adjusting at the day's practice rounds or putting will be rightfully made with the putter of the present invention with ease and no special tool.

To add to the already good aligning aid of the tail 15 design, the straight extensions of the side screws A and B provide an extra visual aid as well as a structural indicator of the invisible sweet spot to improve the actual approach of the ball into the hole cup.

The present invention contemplates that many changes and modifications may be made. Therefore, while the presently preferred form of the golf putter has been shown and described, and several modifications thereof discussed, persons skilled in this art will readily appreciate that various additional changes and modifications may be made without departing from the spirit of the invention, as defined and differentiated by the following claims.

The invention claimed is:

1. A golf putter comprising:

a. a putter head constituting a main weight of the putter, the putter head having a striking face at a front portion, a top surface extending parallel to the ground and having an opening near its one end to accommodate a shaft with a double bend leading to a grip, a center tail extending rearward away from the front portion from the top surface in perpendicular to the striking face and a couple of threaded side bores opened at an opposite surface of the striking face at both sides of the center tail;

b. a back weight branching centrally perpendicular to a main body of the putter head having a top surface extending to near midway of the length of the tail and merging therewith and a bottom surface lying in flush with the corresponding bottom of the main body and terminating with an end wall tapered gradually toward the main body, the back weight also having a center bore identical in shape, size and direction to the side bores; and c. a group of three elongated screw weights made to have an identical dimension of different metals for giving distinctive weight values in the putter at the bore locations, whereby the center tail provide a principal aligning aid for the correct directional putting by the golfer while the straight extensions of the side screw weights provide an extra visual aid as well as a structural indicator of an invisible sweet spot of the putter.

2. The golf putter set forth in claim 1, wherein the elongated screw weights are made of materials selected from a group consisting of tungsten, white bronze, silicon bronze and aluminum.

3. The golf putter set forth in claim 1, wherein the center tail is painted with white to give a contrasted line on the green ground for promoting a visual alignment to correct the travel of the ball before striking.

4. The golf putter set forth in claim 1, wherein the putter has a T shape.

5. The golf putter set forth in claim 1, wherein the golf putter has three weight ports.

6. The golf putter set forth in claim 1, wherein the putter has a T shape and has three weight ports.

7. A golf putter comprising:

a. a putter head having a striking face, a top surface and a hosel to accommodate a shaft leading to a grip, and threaded side bores on each side of the putter head behind the striking face;

b. a center tail extending rearward from the top surface, perpendicular to the striking face; two screw weights of similar dimension and made of different metals for giving distinctive weight values in the putter at the bores; wherein the center tail forms a straight directional visual aid while the screw weights provide tuning capability to adjust the sweet spot of the putter, further comprising a back weight branching centrally perpendicular to the putter head having a top surface extending from the midway of the tail and merging therewith and a bottom surface lying in flush with the corresponding bottom of the putter head and terminating with an end wall tapered gradually toward the putter head, wherein the back weight also has a center bore identical in shape, size and direction to the side bores.

8. The golf putter set forth in claim 7, wherein the elongated screw weights are made of materials selected from a group consisting of tungsten, white bronze, silicon bronze and aluminum.

9. The golf putter set forth in claim 7, wherein the center tail is painted white to give a contrasted line on the green ground for promoting a visual alignment to correct the travel of the ball before striking.

10. The golf putter set forth in claim 7, wherein the putter has a T shape.

11. A golf putter comprising:

a. a putter head having a striking face, a top surface and a hosel to accommodate a shaft leading to a grip, and threaded side bores on each side of the putter head behind the striking face;

b. a center tail extending rearward from the top surface, perpendicular to the striking face;

c. two screw weights of similar dimension and of different weights for giving distinctive weight values in the putter at the bores; wherein the center tail forms a straight directional visual aid while the screw weights provide tuning capability to adjust the sweet spot of the putter, further comprising a back weight branching centrally perpendicular to the putter head having a top surface extending from the midway of the tail and merging therewith and a bottom surface lying in flush with the corresponding bottom of the putter head and terminating with an end wall tapered gradually toward the putter head, wherein the back weight also has a center bore identical in shape, size and direction to the side bores.

12. A golf putter comprising:

a. a putter head having a striking face, a top surface and a hosel to accommodate a shaft leading to a grip, and threaded side bores on each side of the putter head behind the striking face;

b. a center tail extending rearward from the top surface, perpendicular to the striking face;

c. two screw weights of similar dimension and of different weights for giving distinctive weight values in the putter at the bores; wherein the center tail forms a straight directional visual aid while the screw weights provide tuning capability to adjust the sweet spot of the putter, wherein the elongated screw weights are made of materials selected from a group consisting of tungsten, white bronze, silicon bronze and aluminum.

13. A golf putter comprising:

a. a putter head having a striking face, a top surface and a hosel to accommodate a shaft leading to a grip, and threaded side bores on each side of the putter head behind the striking face;

b. a center tail extending rearward from the top surface, perpendicular to the striking face;

c. two screw weights of similar dimension and of different weights for giving distinctive weight values in the putter at the bores; wherein the center tail forms a straight directional visual aid while the screw weights provide tuning capability to adjust the sweet spot of the putter, wherein the center tail is painted white to give a contrasted line on the green ground for promoting a visual alignment to correct the travel of the ball before striking.

14. A golf putter comprising:

a. a putter head having a striking face, a top surface and a hosel to accommodate a shaft leading to a grip, and threaded side bores on each side of the putter head behind the striking face;

b. a center tail extending rearward from the top surface, perpendicular to the striking face;

c. two screw weights of similar dimension and of different weights for giving distinctive weight values in the putter at the bores; wherein the center tail forms a straight directional visual aid while the screw weights provide tuning capability to adjust the sweet spot of the putter, wherein the putter has a T shape.

* * * * *